US005557178A

United States Patent [19]

Talman

[11] Patent Number: 5,557,178

[45] Date of Patent: Sep. 17, 1996

[54] CIRCULAR PARTICLE ACCELERATOR WITH MOBIUS TWIST

[75] Inventor: Richard M. Talman, Ithaca, N.Y.

[73] Assignee: Cornell Research Foundation, Inc., Ithaca, N.Y.

[21] Appl. No.: 332,038

[22] Filed: Nov. 1, 1994

[51] Int. Cl.[6] ..... H05H 11/00; H05H 13/00

[52] U.S. Cl. ..... 315/501; 315/500; 315/504

[58] Field of Search ..... 315/500, 501, 315/503, 504

[56] References Cited

U.S. PATENT DOCUMENTS

| | | | |
|---|---|---|---|
| 3,342,029 | 9/1967 | Gordon | 315/503 |
| 3,617,908 | 12/1971 | Greber . | |
| 3,629,576 | 12/1971 | Enge . | |
| 4,063,098 | 12/1977 | Enge . | |
| 4,122,346 | 10/1978 | Enge . | |
| 4,355,236 | 10/1992 | Holsinger . | |
| 4,429,229 | 1/1984 | Gluckstern . | |
| 4,455,489 | 6/1984 | Brown . | |
| 4,736,106 | 4/1988 | Kashy et al. . | |
| 4,742,224 | 5/1988 | Chu et al. . | |
| 4,745,281 | 5/1988 | Enge . | |
| 4,806,871 | 2/1989 | Ikegami et al. | 315/503 |
| 5,001,437 | 3/1991 | Miyata et al. . | |
| 5,198,674 | 3/1993 | Underwood . | |

OTHER PUBLICATIONS

Filippov, A. N. et al., Proc. HEACC Conf. Hamburg 1992, ed. J. Rossbach, p. 1145.

Kowalski, S. K. et al., Proc. Int. Conf. Magnet. Technol. (Brookhaven), p. 181 (1972).

Oide, K. et al., Phys. Rev. E 47, 2010 (1993).

Danilov et al., "Compensation of the Chromatic Effects in the Novosibirsk ϕ–Factory Lattice", IEEE Particle Accelerator Conference, San Francisco, 1991, Institute of Nuclear Physics, 630090 Novosibirsk, USSR, pp. 186–188.

Barkov et al., "Status of the Novosibirsk Phi–Factory Project", IEEE Particle Accelerator Conference, San Francisco, 1991, Institute of Nuclear Physics, Novosibirsk, USSR pp. 183–185.

*Primary Examiner*—Nimeshkumar D. Patel

*Attorney, Agent, or Firm*—Jones, Tullar & Cooper, P.C.

[57] ABSTRACT

A circular particle accelerator includes a twist element at one location in its ring lattice which interchanges horizontal and vertical betatron oscillations upon each particle passage. Two traversals of the ring are required to return the particle to a corresponding state, thus the accelerator is termed a "Möbius" accelerator. The resultant toggling between transverse oscillation modes causes the accelerator to have remarkable properties, very different and in important ways superior to a conventional circular accelerator. Beam brightness can be increased by increasing the strength of focusing elements in the lattice while still preserving large amplitude stability. Furthermore, the resulting round particle beams generated by the accelerator are shown to be robust against beam-beam interaction, thus permitting use of the accelerator with unseparated, counter-rotating particle beams.

12 Claims, 4 Drawing Sheets

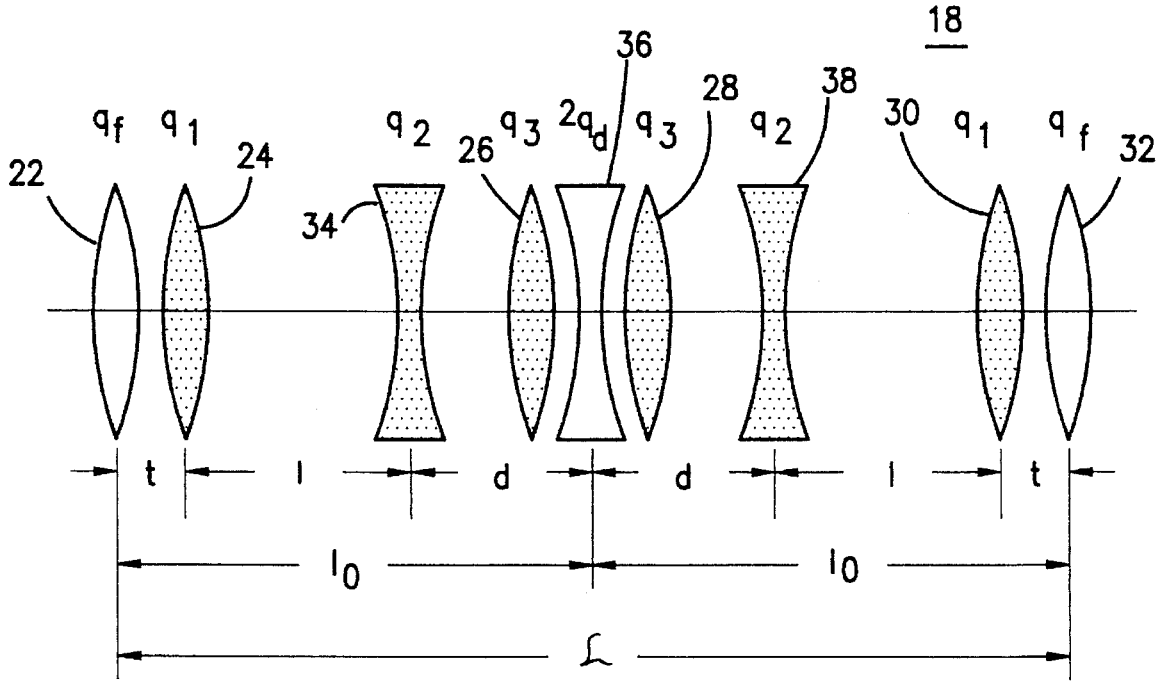
FIG. 2A
FIG. 3A
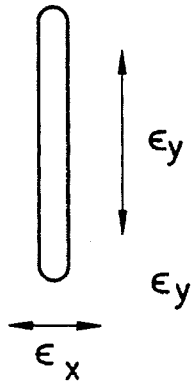
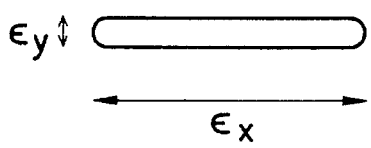
FIG. 3B
FIG. 3C
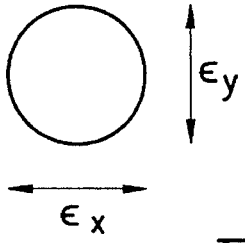
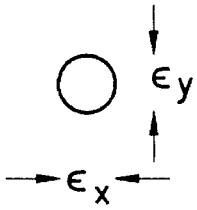
FIG. 3D

CIRCULAR PARTICLE ACCELERATOR WITH MOBIUS TWIST

BACKGROUND OF THE INVENTION

This invention was made with Government support under Grant No. NSF PHY-9310764, awarded by the National Science Foundation. The Government has certain rights in the invention.

The present invention relates in general to a circular particle accelerator structure which employs a ring lattice including a twist element that interchanges horizontal and vertical betatron oscillations on each particle passage.

Circular particle accelerators are employed for generating beams of charged particles, including electrons, protons and ions, for use in numerous applications, including scientific experimentation, photon lithography, electron beam lithography, tunable microwave sources, elementary particle physics and medical radiation, for example. As these technologies have progressed, a need has developed for accelerators that can generate particle beams having reduced emittance and therefore increased brightness, reduced lattice complexity and circumference, reduced charge at a given brightness and increased dynamic aperture. Until now, achieving improvements in these parameters has required a complete reconfiguration of the accelerator which is both complex and very expensive. A need therefore exists for an improved circular accelerator design that can achieve the aforementioned improvements in operating parameters without excessive cost or design complexity.

SUMMARY OF THE INVENTION

The present invention seeks to fulfill this need by providing a circular particle accelerator structure that incorporates a simple structural modification which results in the generated particle beam having reduced emittance and spot size, and therefore increased brightness, as well as reduced lattice complexity, reduced charge at a given brightness and increased dynamic aperture. In particular, this is achieved by providing a conventional circular particular accelerator with a "twist" element at one location in the accelerator's ring lattice that is configured to interchange horizontal and vertical betatron oscillations on each particle passage. With this arrangement, two traversals of the ring by a particle are required to return the particle to its original state, and thus this twist element can be referred to as a "Möbius" twist. This results in toggling between transverse oscillation modes induced by the "Möbius" twist element that causes the generated particle beam, which normally possess an oblong cross section, to have a nearly circular or round cross section since the beam is never allowed to completely stabilize in one transverse oscillation mode or the other. The toggling between horizontal and vertical motion reduces the required strengths and numbers of nonlinear chromatic (momentum) compensation sextupole elements. This permits stronger focusing hence reduced emittance, increased brightness, and increased dynamic aperture. In addition, the toggling enables the accelerator to be used with counter-rotating particle beams without the need for beam separation elements because the toggling action results in automatic compensation of any interference generated between the two unseparated beams.

BRIEF DESCRIPTION OF THE DRAWINGS

The advantages and features of the present invention will become apparent from the following detailed description of a preferred embodiment thereof, taken in conjunction with the accompanying drawings in which:

FIG. 2A is a schematic illustration of a first preferred embodiment of a "twist" element that forms a part of the accelerator of FIG. 1 and serves to interchange horizontal and vertical betatron oscillations of a particle as it is accelerated;

FIGS. 3A–3D are cross-sectional illustrations of a particle beam with FIG. 3A illustrating a ribbon shaped beam generated in the accelerator of FIG. 1 when the twist element is not activated, FIG. 3B illustrating the ribbon shape of the particle beam after it has been twisted to a vertical phase by a single passage through the twist element when it is activated, FIG. 3C illustrating the resulting round cross section of the beam which occurs during rapid, sequential shifting back and forth between horizontal and vertical phases by the twist element, and FIG. 3D illustrating the round beam resulting from stronger focusing.

DETAILED DESCRIPTION OF A PREFERRED EMBODIMENT

Figure 1:
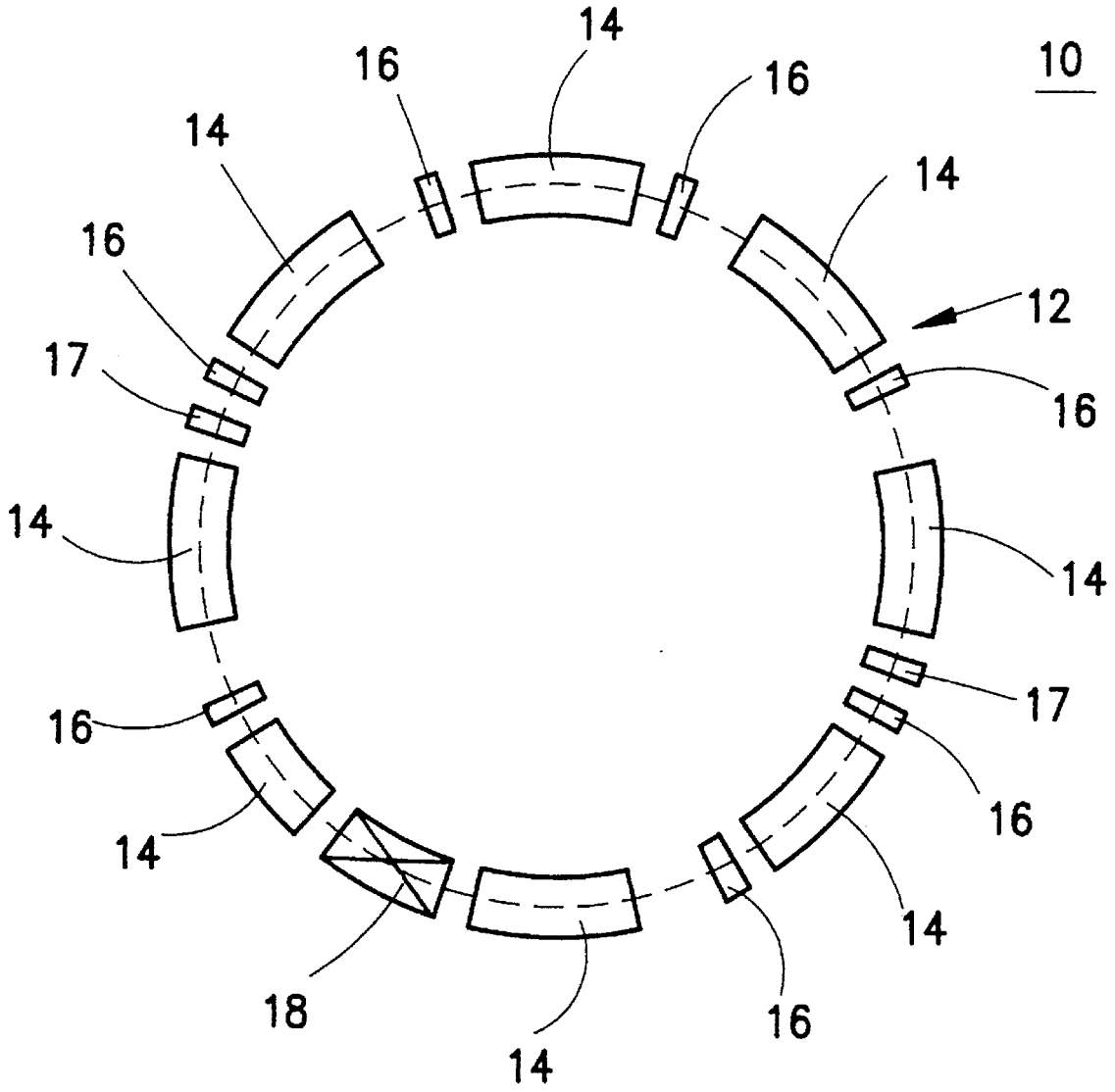
FIG. 1 is a schematic illustration of a circular accelerator constructed in accordance with a preferred embodiment of the present invention.

Turning now to a more detailed consideration of a preferred embodiment of the present invention, FIG. 1 illustrates a circular particle accelerator 10 which, as is conventional, includes a ring shaped lattice 12 comprised of a plurality of bending or dipole magnets 14 and a plurality of focusing or defocusing quadrupole magnets 16 which are interspersed between adjacent ones of the bending magnets 14. First and second chromaticity correcting elements 17, otherwise known as sextupole magnets, are inserted in the lattice 12 after every fourth quadrupole magnet 16. For reasons discussed later, this arrangement differs from that of conventional accelerators in which a chromaticity correcting element is typically placed after every quadrupole magnet.

The key feature of the present invention is that the lattice 12 includes a twist element 18 that is inserted between two adjacent ones of the bending magnets 14 and serves, when actuated, to interchange horizontal and vertical betatron oscillations of the accelerated particles each time they pass through. With the presence of the twist element 18, the lattice 12 can be termed a "Möbius-twisted lattice" because the twist element 18 causes the accelerated particles to interchange oscillation phases on their first pass through the twist element 18, and then interchange oscillation phases once again back to their original phase on the second pass. As will be demonstrated later, the presence of the twist element 18 results in the ability to increase the focusing strength of the quadrupole magnets 16 substantially, and eliminates the requirement that the sextupoles 17 be able to compensate for chromaticity in both vertical and horizontal directions. Instead, all that is needed is compensation in the horizontal direction.

FIG. 2A illustrates a first preferred form of the twist element 18. As illustrated, it is comprised of six focusing elements or lenses 22, 24, 26, 28, 30 and 32, and three defocusing elements or lenses 34, 36 and 38. It will be understood that these elements are not optical lenses, but rather are formed from quadrupole electromagnets that are configured either to focus or defocus a charged particle beam as it passes through them. The two outer focusing lenses 22 and 32 labelled $q_f$ in combination with the centrally located defocusing lens 36 labelled $2q_d$ form equal-tune FODO (focus-defocus) elements which operate as conventional quadrupoles when they are powered and the remaining lenses are not. The six remaining lenses, 24, 26, 28, 30, 34 and 38 are positioned as skew quadrupoles which, when powered, interchange horizontal (x) and vertical (y) betatron oscillations when particles pass therethrough. In this mode of operation, otherwise known as Möbius operation, the central defocusing element 36 is turned off and the skew quadrupole elements are powered. It should be noted that the three elements 26, 28 and 36, ideally superimposed, can be replaced by a single quadrupole if it can be rotated around the longitudinal axis.

In order to operate properly, the twist element 18 requires a drift of length L, the "optical length" of the six element (lenses 24, 26, 28, 30, 34 and 38) line. L can be adjusted to be equal to 10, the half-length of the original FODO cell comprising lenses 22, 32 and 36. More precisely, the thin "end lengths" t illustrated in FIG. 2 should be accounted for by setting $L+2t=0_0$. In this case, there is a perfect match because the optical length between the end quadrupole lenses 22 and 32 labelled $q_f$, is then $1_0$, and the interchange of x and y causes the second quadrupole comprised of lenses 32 to have the correct focus/defocus polarity so that it can act as the next quadrupole in the FODO half-cell from 22 to 32. As a result, the twist element 18 either acts as a conventional full FODO cell using lenses 22, 36 and 32, or becomes optically a half-cell which also interchanges x and y. Typical quadrupole strengths to achieve this, expressed in terms of the original quadropoles are $q_1=1.6\ q_f$, $q_2=-2.6\ q_f$, and $q_3=2.7\ q_f$. Practical, conceptual designs exist for incorporating such Möbius twists into existing circular particle accelerators, such as for example, the Cornell Electron Storage Ring (CESR) at the Laboratory of Nuclear Studies, Cornell University, and the Tevatron, located at Fermi National Laboratory in Batavia Ill., and most of the features described herein have been confirmed using realistic simulations.

Figure 2B:
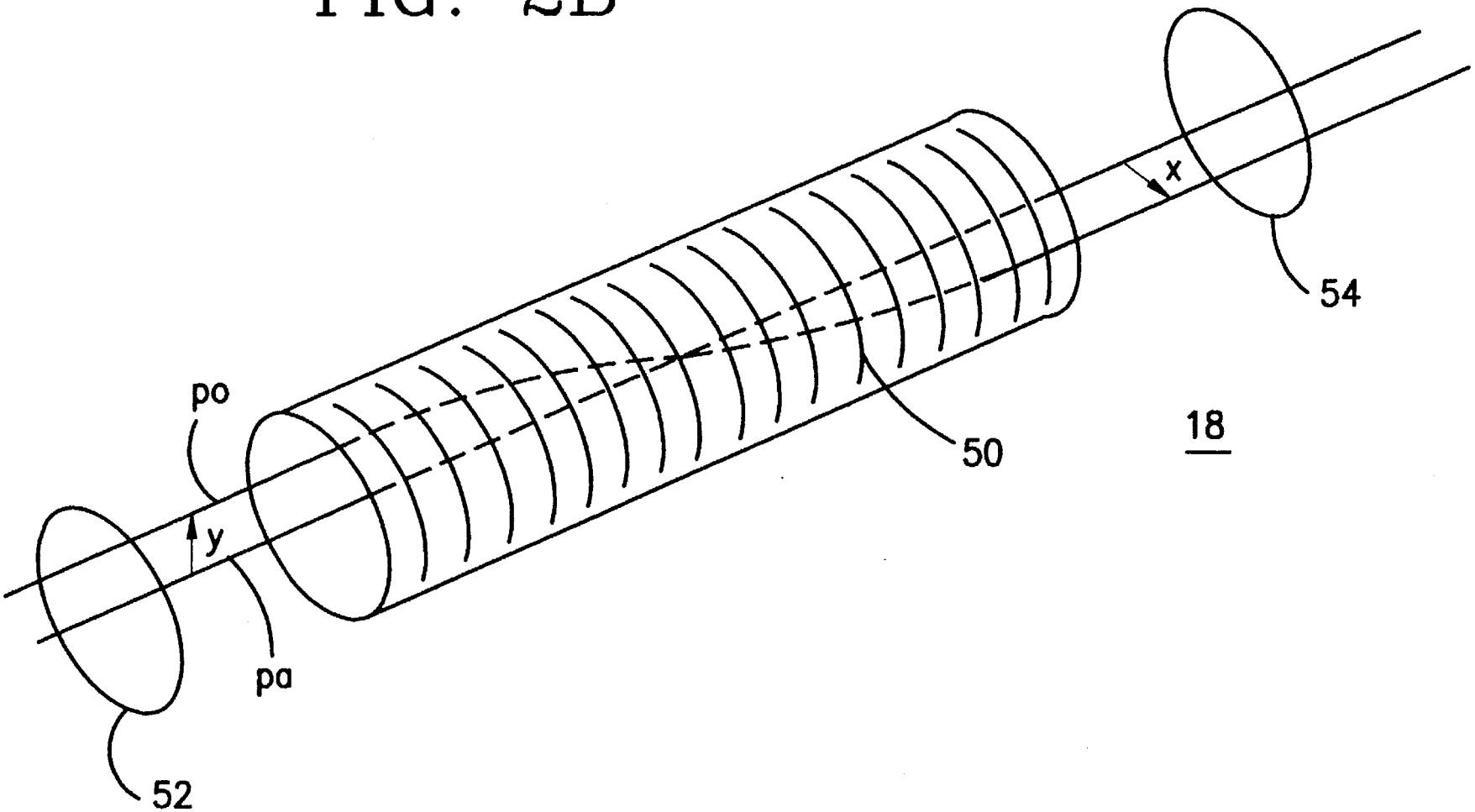
FIG. 2B is a schematic illustration of a second preferred embodiment of the "twist" element.

A second embodiment for the twist element 18 is illustrated in FIG. 2B. In particular, FIG. 2B illustrates the twist element 18 as being formed from a single solenoid coil 50 and a pair of focusing elements 52 and 54. The solenoid coil element 50 is of length L and longitudinal field B, and is positioned along the central path axis pa of the accelerator ring lattice. Since the dominant, linearized, effect of the coil 50 is to rotate transverse betatron amplitudes through angle KL where K=cB/(2pc/e), the displaced particle orbit labelled po will rotate from the y direction to the x direction as illustrated in FIG. 2B if $KL=\pi/2$ (B is the magnetic field in Tesla, $C=3\times10^8$ m/sec, and (pc/e) is the particle voltage in volts.). In this case, the solenoid coil 50 cannot simply be inserted into an available straight section of the ring lattice, both because the proper beam matching will not normally be satisfied at that location, and because the linearized solenoid model also requires half-drifts of length L/2 and a "lens", inverse focal length $K^2/L$, focusing in both planes. The focusing elements 52 and 54, one of which is positioned adjacent a first end of the solenoid coil 50 and the other of which is positioned adjacent the second, opposite end of the solenoid coil 50, are therefore employed to provide the necessary beam matching of the coil 50 to the rest of the accelerator lattice.

The solenoid embodiment of FIG. 2B is particularly attractive for use in low energy electronic accelerators which do not exceed 1 GeV. For example, at 1 GeV, BL is 10 Tesla-meters which can be easily accommodated by conventional equipment. Higher energy levels substantially in excess of 1 GeV become a problem, however, since they require too large of a magnetic field, and cannot be feasibly implemented. The lower energy electronic accelerators are particularly useful in photon and electron lithography.

An analysis of the Möbius-twisted lattice 12 of the circular accelerator 10 will now be presented. Before the twist element 18 is inserted, because of the inherent periodicity of a closed ring, "betatron" oscillations (transverse) can be described with the help of Floquet functions $\beta_x(s)$ and $\beta_y(s)$, depending on arc length coordinates s. The "Möbius" designation is intended to convey a picture in which $\beta_x$ and $\beta_y$ form a single function, repeating after two revolutions rather than one. Thinking of $\beta_x$ as plotted on one "side" of a strip and $\beta_y$ on the other, the strip is cut, twisted, and then reconnected with $\beta_x$ connected to $\beta_y$ and $\beta_y$ connected to what previously was $\beta_x$ (or $-\beta_x$). Since the β-functions are inherently positive quantities, one of these operations may also entail a betatron phase shift π.

Here it is shown how this lattice separation, twist and reconnection can be performed with realizable physical elements that are compatible with any pre-existing accelerator. It simplifies analysis to imagine this occurring in a zero-length interval, and such a transformation, even though discontinuous, is symplectic. But naturally the elements required (either a set of skew quadrupoles or a solenoid) necessarily have non-zero length. However, without essential loss of generality, by redefining slightly what constitutes "the rest of the lattice", it is not wrong to treat the twist as occurring over zero length. Letting x and y be horizontal and vertical coordinates of a particle at that point, when reconnecting the lattice after breaking it open, there are two seemingly different possibilities. One is a rotation through π/2 around a longitudinal axis: $x\rightarrow y$, $y\rightarrow -x$. The other is a reflection in the x,y diagonal: $x\rightarrow y$, $y\rightarrow x$. For issues considered important here, these two possibilities are essentially equivalent, one differing from the other by a π phase shift that can be subsumed in the rest of the ring.

Single particle dynamics in the Möbius accelerator 10 does not depend on particle type (electron, proton, or ion) and this causes all to share similar features. The only essential difference arises from the fact that, whereas hadron beams are approximately round, the electron beams in existing accelerators are ribbon-like, with beam height much less than beam width. More precisely, "emittances" $\epsilon_x$ and $\epsilon_y$ (—width times angular—width products, conserved as the beam traverses the lattice—) satisfy $\epsilon_y<<\epsilon_x$. For a beam of N particles, the "horizontal beam brightness", defined by $N/\epsilon_x$, with similarly defined vertical brightness, are the appropriate measures of beam density in cases where minimizing spot size is important. With the twist element 18 present, the otherwise ideal ring 12 acquires a split personality, with each accelerated particle toggling regularly between a horizontal and a vertical phase as depicted in FIG. 3B. This removes the global distinction between horizontal and vertical motion. If it is an electron beam, the "beam heating" due to quantum fluctuations of synchrotron emission excites horizontal oscillations during both phases, which, radiation being random, excites both planes equally over time. The effect of including the twist element 18 then is $\epsilon_x\rightarrow\epsilon_x/2$ and $\epsilon_y<<\epsilon_x\rightarrow\epsilon_y=\epsilon_x$ as illustrated in FIG. 3C; such a beam will be called "round".

What are the effects of introducing the twist element 18, first supposing that no other changes are made? For a colliding beam accelerator, round beams are advantageous because they permit increased luminosity and interaction rate. For electron accelerators used as sources of synchrotron radiation beam brightness is similarly important. Some experiments need a bright horizontal line source, and for those the twist element 18 would have to be turned off, as the increase in $\epsilon_y$ due to its presence would be undesirable. But for applications requiring a point source, for example to perform a raster scan, the halving of $\epsilon_x$ would be advantageous. Next consider the effects of other lattice changes the twist element 18 makes possible. Greater benefits can be achieved. Of these the greatest is the freedom to increase the focussing strength of all lattice elements or magnets, to be justified below, since this can result in greatly reduced emittances, and thus a smaller beam diameter as illustrated in FIG. 3D. Reductions by a factor of five of $\epsilon_x$ and $\epsilon_y$ are practical. Taking these effects together, the presence of the Möbius twist permits an increase of about a factor of ten in the rate of particle passage per unit transverse area at a given point along the beam line. Other lattice properties, especially resonances, are greatly affected by the presence of the twist, as will be discussed below.

Traditional betatron theory relies heavily on "Floquet theory" which is applicable to periodic lattices. Since the twist element 18 alters this symmetry, significant differences are to be expected. The proposed coupling has the property that the transfer matrix is still fully described by two 2×2 matrices; this permits a closed-form analysis, only moderately more complicated than traditional uncoupled analysis. Of course, imperfections in the coupling elements will violate this representation, but such effects can be analyzed perturbatively, as is customary. Existing computer codes for evaluating lattice functions cannot be used directly, as they rely on the approximate block-diagonal structure of the transfer matrix, but they can (in principle) be made to work by working with a "twice-around" lattice. On the other hand, particle tracking codes can be used directly, and their output can be used to analyze lattice performance, for example by Fourier transformation.

Ideally, the lattice 12 should be "matched" at the location of the twist element 18; that is, the β-functions should satisfy $\beta_x=\beta_y\equiv\beta$ and $\beta'_x=\beta'_y=0$, where primes indicate d/ds. In that case a beam suffers no phase space distortion or density dilution in passing through the element. The analysis assumes that this matching condition is approximately, but not exactly, satisfied. The 4×4, partitioned, once-around transfer matrix is $$M=\begin{pmatrix}0 & -1\\ 1 & 0\end{pmatrix}\begin{pmatrix}X & 0\\ 0 & Y\end{pmatrix}=\begin{pmatrix}0 & -Y\\ X & 0\end{pmatrix}, \tag{1}$$

where X and Y are 2×2 matrices describing pure x and pure y motion in the uncoupled lattice. This matrix acts on the phase space column vector $(x,x',y,y')^T$ to describe once-around particle evolution in the twisted lattice.

Useful in describing coupled motion is the 2×2 off-diagonal combination $E=X+Y^{-1}$. Define $E=\det|E|$. Because M is symplectic, its eigenvalues are known to form reciprocal pairs, $\lambda$ and $1/\lambda$, both lying on the unit circle. As a result, their sum $\Lambda=\lambda+1/\lambda=2\cos\mu\equiv2\cos(2\pi Q)$ is known to be real. The physically measurable normal mode tunes, or frequencies, are $$Q\pm=\frac{1}{2\pi}\cos^{-1}\frac{\pm\sqrt{E}}{2}, \tag{2}$$

These equations have immediate observational consequences as the frequencies are readily measurable by spectrum analyzing the output of a transverse beam position monitor. One important implication is that the very existence of stable oscillations is keyed to the sign and magnitude of E; for $0\leqq E\leqq4$, both tunes are real and the motion is stable. Another is that, because the cosine function is anti-symmetric about π/2, the two tunes are symmetrically placed, above and below 0.25. This is certainly counter-intuitive since, though one is accustomed to two tune lines, one expects to be able to adjust their frequencies independently, and also their amplitude ratio. The simultaneous presence of two identical lines indicates the motion is not simple harmonic (on a turn-by-turn basis). In the special case that E=0the tune lines merge at 0.25.

In a conventional accelerator lattice, any particle orbit is a superposition of four normal mode orbits (two equal-tune pairs). Each solution, because it "toggles" regularly between horizontal and vertical when the twist element 18 is present, yields another solution, identical except for having horizontal and vertical intervals interchanged. Clearly, when viewed over an even number of turns, these two orbits must exhibit identical tunes. Since the orbit differential equation has a definite number of independent solutions, this new symmetry imposes a reduction in the number of independently controllable parameters, as observed above. This new degeneracy persists even with nonlinear elements present.

Errors will inevitably cause the lattice to be unmatched to some degree, but this will not cause qualitative difference. The eigenvalues of the once-around transfer matrix are "locked" onto the unit circle in the complex plane. Escape and "bifurcation" is possible only at two points (intersections with the real axis) of this circle. In the neighborhood of a stable operating point that is remote from these two points, there is substantial robustness of qualitative behavior. This means that minor imperfection of the elements making up the twist element 18 will not change the qualitative behavior of the lattice. On the other hand, the Möbius lattice clearly inhabits a "branch" of the parameter space that is disconnected from the familiar uncoupled lattice case. This may account for behavior that seems anti-intuitive.

The standard "Twiss" parameterization of X is $$X=\begin{pmatrix}C_x+\alpha_xS_x & \beta_xS_x\\ -\gamma_xS_x & C_x-\alpha_xS_x\end{pmatrix}, \tag{3}$$

where $\alpha_x=-\beta'_x/2$, $\gamma_x=(1+\alpha^2_x)/\beta_x$, $C_x=\cos\mu_x$, $S_x=\cos\mu_x$, and similarly for y. In terms of these parameters E is given by $$E=2-2\cos(\mu_x+\mu_y)+S_xS_yR \text{ where } R= \tag{4}$$

$$\left(\sqrt{\beta_x/\beta_y}-\sqrt{\beta_y/\beta_x}\right)^2+\left(\sqrt{\beta_x/\beta_y\,\alpha_x}-\sqrt{\beta_y/\beta_x\,\alpha_x}\right)^2$$

Figure 4:
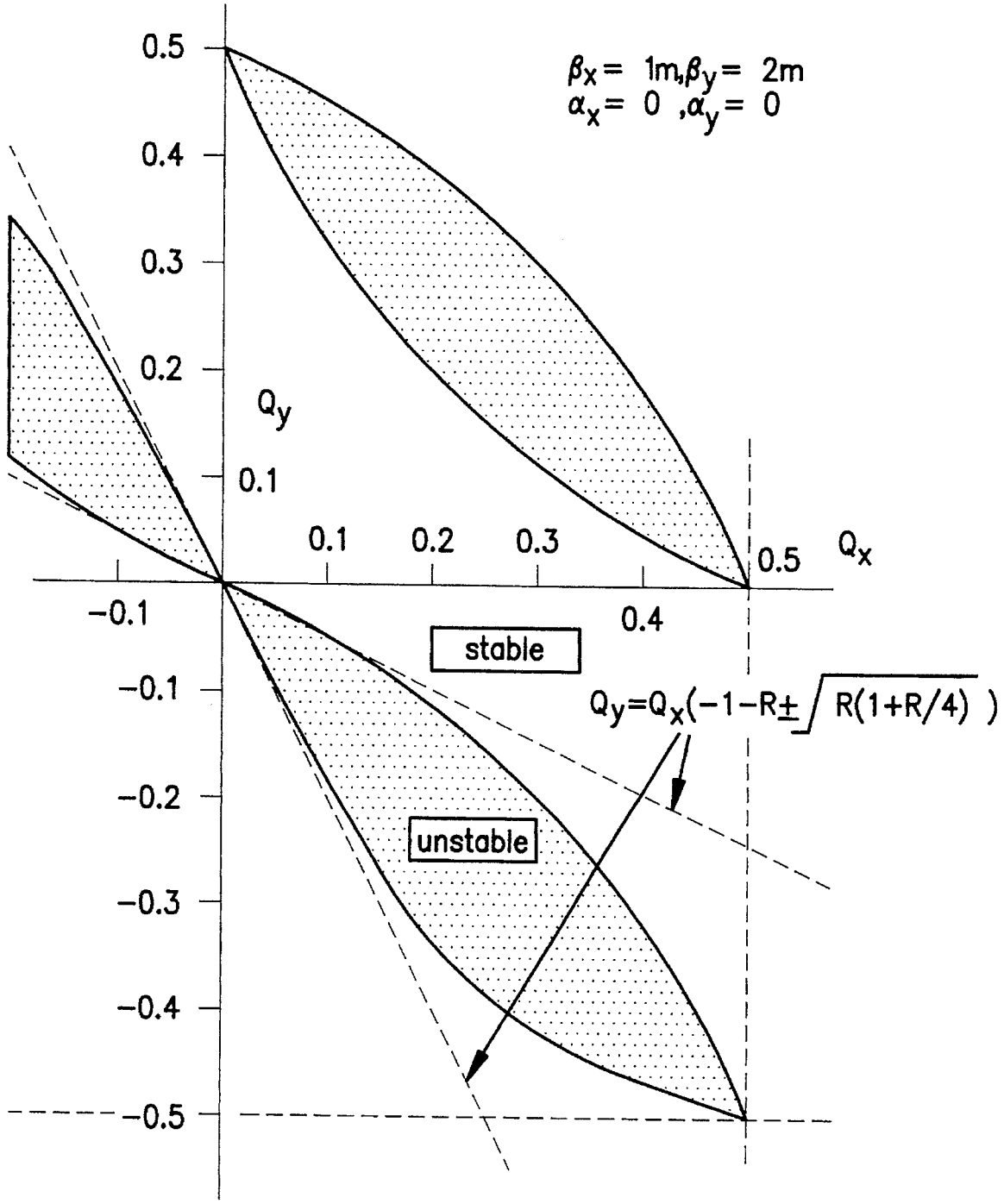
FIG. 4 is a graph depicting stable and unstable regions of the $Q_x$, $Q_y$ tune-plane for a grossly mismatched yet still operable, Möbius-twisted storage ring lattice.

By design, since R=0, then $0\leqq E\leqq4$, making the twisted lattice stable, with $\mu\pm=(\mu_x+\mu_y\pm\pi)/2$. (After aliasing into the tune range from 0 to 0.5 these appear symmetric about 0.25). Because some mismatch is inevitable, in practice $0<R<<1$. In the graph of FIG. 4, to exaggerate the effect, a "gross" mismatch $\beta_x=1$m, $\beta_y=2$m, $\alpha_x\alpha_y=0$, is assumed and stability boundaries are plotted. Though ten times worse than could be achieved easily, and perhaps one hundred times what could be reliably obtained in practice, instability excludes only a modest region of tune space. On the other hand, there is an essential singularity at the origin and slivers of instability lying in the wedges between the straight lines $Q_y=Q_x(-1-R\pm\sqrt{R(1+R/4)})\approx Q_x(-1\pm\sqrt{R})$. These are indicated by dotted lines in FIG. 4.

To predict the performance of an accelerator it is necessary to be able to calculate the effects of small imperfections. Let $X_t=(x_t, x'_t)^T$ and $Y_t=(y_t, y'_t)^T$ be phase space coordinates on turn t and let $\Delta X'_t(P)=(0,\Delta x'_t(x_t(P),y_t(P)))^T$ and $\Delta Y'_t(P)$ be deflections occurring at location P on turn t. For the M öbius accelerator 10 it is convenient to analyze the effects of these perturbations after two complete turns rather than one. If there are perturbations away from the ideal linear machine lattice they influence every turn. For that reason the response to errors of the twice-around machine is not at all the same as would be the case if the machine truly had independent elements strung out along twice the circumference. Also, since motion flips from plane to plane, a perturbing element causing horizontal force on one turn tends to cause vertical on the next and vice versa. The effects of a lattice imperfection depend on its location P. Generalizing Equation (1), forward and backward, once-around, evolution at P is described by matrices $$M(P)=\begin{pmatrix} 0 & -X_1Y_2 \\ Y_1X_2 & 0 \end{pmatrix},\ M(P)^{-1}=\begin{pmatrix} 0 & X_2^{-1}Y_1^{-1} \\ -Y_2^{-1}X_1^{-1} & 0 \end{pmatrix}, \tag{5}$$

where the transfer matrices have been factorized, $X=X_2X_1$, $Y=Y_2Y_1$. For example, $X_1$ represents horizontal propagation from the twist to the point P, and $X_2$ from there on around to the twist.

Starting from these equations and neglecting terms quadratic in deflections, the following fifth-order difference equation can be derived $$X_{t+2}+(2-E)X_t+X_{t-2}=-X_1(YX-X^{-1}Y^{-1})\,X^{-1}{}_1{}^{\Delta}X'_t/2+-2X_1Y_2{}^{\Delta}Y'_{t+1}/2-2X^{-1}{}_2Y^{-1}{}_1{}^{\Delta}Y'_{t-1}/2+{}^{\Delta}X'_{t+2}/2-{}^{\Delta}X'_{t-2}/2, \tag{6}$$

and $Y_t$ satisfies a similar equation. Knowing that the coefficient of $x_t$ is equal to $-2\cos\mu^{(2)}$, where $\mu^{(2)}/(2\pi)$ is the tune of the twice-around machine, then $\cos\mu^{(2)}=-1+E/2$, which agrees with Equation (2), because $\cos(\mu(2))=\cos(4\pi Q\pm)$.

Ideally, there being no errors, all terms on the R.H.S. of Equation (6) vanish. In that case, as is common with waves, all components satisfy the same equation, and most results follow from the equation for any one, say the one for $x_t$;

$$x_{6-2}+(2-E)x_t+x_{6-2}=-sin(\mu_x+\mu_y)^{\Delta}x'_t\beta_{Px}++sin(\mu_{x2}+\mu_{y1})^{\Delta}y'_{t-1}\beta_{Py}-sin(\mu_{x1}+\mu_{y2})^{\Delta}y'_{y+1}\beta_{Py} \tag{7}$$

where betatron phase angles from the twist element 18 to P have been introduced. This form suggests the possibility, not present in conventional accelerators, of self-cancellation of a defect over more than one turn. With some loss of generality, taking $\alpha_x\alpha_y=0$, $\beta_x=\beta_y=1$, a particular unperturbed solution can be written $$X_t=\frac{\alpha}{2}\begin{pmatrix} \cos\frac{\mu_x+\mu_y+\pi}{2}\,t+\cos\frac{\mu_x+\mu_y-\pi}{2}\,t \\ -\sin\frac{\mu_x+\mu_y+\pi}{2}\,t-\sin\frac{\mu_x+\mu_y-\pi}{2}\,t \end{pmatrix}= \tag{8}$$

$$\alpha\cos_2{}^{\alpha}-t\begin{pmatrix} \cos\frac{\mu_x+\mu_y}{2}\,t \\ -\sin\frac{\mu_x+\mu_y}{2}\,t \end{pmatrix}y_t\mathrm{T}_1=$$

$$\mathrm{T}_{\alpha\cos_2{}^{\pi}}-t\cos\left(\frac{\mu_x+\mu_y}{2}\,t\,\mathrm{T}_{\mu_{x(1,2)}}\mathrm{T}_{\mu_{y(1,2)}}\right),$$

For perturbations independent of t, (i.e. steering errors), and perturbations linear in x or y, (i.e. quadrupole errors), Equation (7) can be solved in closed form. For nonlinear effects it can be solved perturbatively and iteratively, initially using Equation (8), to approximate the R.H.S. Then, expanding by Fourier transformation in harmonics labeled by integer r, seeking a similarly expansion for $x_t$, and using the trigonometric identity $$cos(r\mu(t+2))+(2-E)cosr\mu t+cos(r\mu(t+2))=2\ (cos(2r\mu)+1-E/2)cosr\mu t \tag{9}$$

to simplify the L.H.S., an improved solution is obtained. Since the coefficient of $\cos r\mu t$ in Equation (9), is capable of becoming small or vanishing, and appears in the denominator of the improved solution, there is (as usual) the hazard of resonance at rational tunes.

Using this method of approximation to analyze various cases, some conclusions can be drawn. Spectra measured in the horizontal and vertical plane are the same, symmetric about 0.25 in linear approximation, and the spectra of nonlinear harmonics are also identical. There is a strong tendency toward cancellation of tune shifts due to quadrupole perturbations. This is because a tune increase on one turn is necessarily accompanied by a tune decrease on the next. The head-on beam-beam interaction does not benefit from the cancellation of linear tune shifts just mentioned, because it is "focusing" in both planes. On the other hand, there is partial cancellation of "parasitic" beam-beam tune shifts due to beams that are separated, but share the same vacuum chamber, as for example at CESR, LEP, and the Fermilab Tevatron.

Turning to nonlinear effects, for colliding beams there is a benefit to round beams, no matter how they have been brought into existence-the nonlinear beam-beam motion becomes effectively one-dimensional, which raises its instability threshold. Other benefits result only because of the twist element 18. If $Q_x+Q_y$ is close to an integer, making $\epsilon<<1$, nonlinear perturbing elements with even symmetry (sextupoles being the leading example) are not resonant, as can be confirmed using Equation (9) with $r=2$, $\mu\approx\pi/2$. Since constant steering errors have this same (even) symmetry and absence of resonance, they also favor operation with $Q_x+Q_y$ close to an integer.

On the other hand nonlinear perturbations with odd symmetry (head-on beam-beam interactions being the leading example) lead to vanishing denominators for $Q_x+Q_y$ close to an integer. However, if the beams are round, it is found that the numerators vanish in this case, due to cancellation from successive turns. In fact, simulation shows that beam-beam forces, no matter how strong, (provided there is no other nonlinearity or physical aperture limitation) cause no particle loss in the Möbius lattice 12 no matter what the tunes or interaction locations. This shows also that the accelerator 10 can be used with unseparated, counter-rotating beams because the toggling of the beams by the twist element 18 results in cancellation of beam to beam interference effects. One can conjecture that stability near the resonance is enhanced by the cancellation just mentioned, and everywhere else because the perturbing force becomes small at large amplitudes. The cancellation that has been described is possible only because the beam-beam cubic force has been assumed to be "central", with $x^3$ and $y^3$ (and all other odd powers) having equal coefficients. This would be true only for found beams interacting at points with matched β-functions.

There is another important, if rather technical, advantage of the Möbius accelerator 10, arising from the need for "chromaticity compensation"; i.e. making the tune dependencies on momentum, $X_x=d\mu_x/dp$ and $X_y=d_y/dp$, small. Uncompensated, $X_x$ and $X_y$ are naturally large and negative. This compensation is necessary, for all high energy accelerators, to avoid the "head-tail" effect, and to avoid other resonances by making the tune plane "footprint" small. Chromaticity compensation requires the sextupoles 17 in the lattice, and their presence necessarily limits the dynamic aperture. In the Möbius accelerator 10, because there is only one tune, there is only one chromaticity. This means that all compensation can be performed in the "easy" direction, horizontal, since each particle spends half of its time in that plane. Although single plane chromaticity compensation means that the particles will only be compensated every second traversal of the accelerator ring since on every other traversal they will be in a vertical oscillation phase, this is acceptable because both reasons for compensating chromaticity have to do with avoiding resonances that cause damage accumulating over many turns. Thus, compensation every two turns will be almost as effective as compensation every turn. Assuming this to be true, $X_x$ and $X_y$ for the untwisted lattice can be allowed to deviate from zero provided their sum is held approximately constant. This is advantageous because the strength of the sextupoles 17 required for a given shift of $X_x$ is about half that required for the same shift of $X_y$.

Furthermore, when needed only in a single plane, all compensation can be performed with "non-interleaved", π-separated, sextupole pairs. In the example embodiment illustrated in FIG. 1, where eight of the quadrupole magnets 16 are employed, each of which therefore causes a π/4 (⅛ wavelength) radian betatron phase shift in the particles, only one of the sextupole magnets 17 is required after every four the quadrupole magnets 16. Because both of the sextupole magnets 17 compensate chromaticity in the same plane and are separated exactly by one-half wavelength of the particle oscillation frequency (π radians) they can cancel out any nonlinear deflections caused by each other. This cannot be accomplished in a conventional accelerator in which the sextupole magnets are interleaved so that a horizontal direction compensating sextupole follows a vertical direction compensating sextupole, and vice versa.

This issue of chromaticity compensation is by no means academic, either for synchrotron light sources or colliding beams. The factor of five reduction in emittance mentioned above was the result of applying these ideas (conceptually) to a CESR-like lattice. Furthermore, as stated before, colliding beam luminosites are controlled by aperture limitations of the lattice remote from the intersection region. This aperture (fundamentally anyway) is dominated by these very sextupoles. Though the beam-beam force does not by itself lead to instability, it does send particles to amplitudes larger than would be true for single beam operation. These particles can suffer unwanted "extraction" by the chromaticity compensation sextupoles 17.

It should be noted that if the accelerator 10 is employed with two counter-rotating beams, not only does the twist element 18 eliminate the need for beam separation elements, but it also eliminates the need for the chromaticity compensating sextupole 17 entirely. This is because tune spread due to nonlinearity of the forces between unseparated beams cancels the destructive chromatic effect of a beam on itself.

Summarizing, in an idealized model of colliding beam operation, not counting the physical vacuum chamber aperture, there are only two fundamental, inevitable, dominant, lifetime limiting elements, the beam-beam interaction and the chromaticity compensating sextupoles 17. It has been shown that the Möbius lattice permits the substantial amelioration of both effects. For single beam operation, M öbius operation allows the generation of reduced emittance beams.

Although the present invention has been disclosed in terms of a preferred embodiment, it will be understood that numerous modifications could be made thereto without departing from the scope of the invention as defined in the following claims.

What is claimed is:

1. A circular accelerator structure for accelerating charged particles comprising:

(a) a ring shaped lattice comprising:

(1) a first plurality of spaced dipole magnets arranged in a ring shape for causing charged particles to bend and thereby travel around said ring shaped lattice; and (2) a plurality of focusing magnets, each disposed between adjacent ones of said dipole magnets for focusing charged particles as they traverse said ring shaped lattice; and (b) means to interchange horizontal and vertical betatron oscillation phases of each charged particle only once for every traversal of said ring shaped lattice by each charged particle to cause the horizontal and vertical betatron oscillation phases to alternate during each successive traversal of said ring shaped lattice.

2. The structure of claim 1, wherein said means to interchange comprises a twist element disposed in said ring shaped lattice.

3. The structure of claim 2, wherein said twist element further comprises a plurality of focusing and defocusing elements arranged to interchange horizontal and vertical betatron oscillations of a charged particle as it passes through said twist element, and provide necessary matching between said twist element and said lattice.

4. The structure of claim 2, wherein said twist element further comprises a solenoid positioned to generate a longitudinal magnetic field along a particle path axis of said ring shaped lattice.

5. The structure of claim 1, further including chromaticity correction means disposed in said ring shaped lattice, said chromaticity compensation means serving to compensate chromaticity in two perpendicular directions, but only performing chromaticity compensation in one of said directions.

6. The structure of claim 5, wherein said chromaticity compensation means further comprises first and second sextupole magnets disposed in said ring shaped lattice and spaced from one another by ½ wavelength of the particle oscillation frequency.

7. A circular accelerator structure for accelerating two unseparated counter-rotating charged particle beams comprising:

(a) a ring shaped lattice comprising:

(1) a first plurality of spaced dipole magnets arranged in a ring shape for causing said two beams to bend and thereby travel around said ring shaped lattice in opposite directions; and (2) a plurality of focusing magnets, each disposed between adjacent ones of said dipole magnets for focusing charged particles in said two beams as they traverse said ring shaped lattice; and (b) means to cancel destructive chromatic effect of one of said beams on itself, wherein said means to cancel comprises a twist element disposed in said ring shaped lattice which interchanges horizontal and vertical betatron oscillation phases of said charged particles in each of said beams only once for every traversal of said ring shaped lattice by said charged particles to cause the horizontal and vertical betatron oscillation phases to alternate during each successive traversal of said ring shaped lattice.

8. A method for accelerating charged particles comprising the steps of:

(a) providing a ring shaped circular accelerator lattice for accelerating charged particles;

(b) accelerating charged particles in said ring shaped circular lattice; and (c) interchanging horizontal and vertical betatron oscillation phases of said charged particles only once for every traversal of said ring shaped lattice to cause the horizontal and vertical betatron oscillation phases to alternate during each successive traversal of said ring shaped lattice.

9. The method of claim 8, further comprising the step of performing chromaticity compensation in a single direction once for every two traversals of said ring shaped lattice by said charged particles.

10. The method of claim 9, wherein said step of passing said charged particles through a twist element further comprises passing said charged particles through a plurality of focusing and defocusing elements arranged to interchange horizontal and vertical betatron oscillations of said charged particles as they pass through said twist element.

11. The method of claim 8, wherein the step of interchanging horizontal and vertical betatron oscillation phases further comprises passing said charged particles through a twist element disposed in said ring shaped lattice.

12. The method of claim 11, wherein said step of passing said charged particles through a twist element further comprises passing said charged particles through a solenoid positioned in said ring shaped lattice to generate a longitudinal magnetic field along a particle path axis of said ring shaped lattice.

* * * * *

UNITED STATES PATENT AND TRADEMARK OFFICE

CERTIFICATE OF CORRECTION

PATENT NO. : 5,557,178

DATED : September 17, 1996

INVENTOR(S) : RICHARD M. TALMAN

It is certified that error appears in the above-indentified patent and that said Letters Patent is hereby corrected as shown below:

Claim 10, column 11, line 1, change "10" to --11-- and change "9" to --10--.

Claim 11, column 12, line 1, change "11" to --10--.

Claim 12, column 12, line 1, change "11" to --10--.

Signed and Sealed this

Thirty-first Day of December, 1996

*Attest:*

*Attesting Officer*

BRUCE LEHMAN

*Commissioner of Patents and Trademarks*